US009044769B2

(12) United States Patent
Buschman et al.

(10) Patent No.: US 9,044,769 B2
(45) Date of Patent: Jun. 2, 2015

(54) APPARATUS FOR COATING A PRODUCT AND A SYSTEM FOR INDEXING THE PRODUCT TO BE COATED

(75) Inventors: Westlake David Buschman, Willoughby Hills, OH (US); Thomas Westlake Buschman, Kirtland, OH (US)

(73) Assignee: BUSCHMAN CORPORATION, Cleveland, OH (US)

( * ) Notice: Subject to any disclaimer, the term of this patent is extended or adjusted under 35 U.S.C. 154(b) by 204 days.

(21) Appl. No.: 13/586,367

(22) Filed: Aug. 15, 2012

(65) Prior Publication Data

US 2013/0042806 A1 Feb. 21, 2013

Related U.S. Application Data

(60) Provisional application No. 61/523,519, filed on Aug. 15, 2011.

(51) Int. Cl.
*B05B 13/02* (2006.01)
*B05B 15/08* (2006.01)

(52) U.S. Cl.
CPC ..... *B05B 13/0235* (2013.01); *B05B 15/08* (2013.01)

(58) Field of Classification Search
CPC ..... B05B 13/0235
USPC ..... 118/300, 313–315, 324, 326, 58, 66, 118/319, 320, 500
See application file for complete search history.

(56) References Cited

U.S. PATENT DOCUMENTS 3,730,637 A * 5/1973 Cellini ..... 408/239 R
6,436,189 B1 * 8/2002 Reuscher ..... 118/319
6,911,085 B2 6/2005 Knop

FOREIGN PATENT DOCUMENTS

DE 100 45 515 4/2002

* cited by examiner

*Primary Examiner* — Yewebdar Tadesse
(74) *Attorney, Agent, or Firm* — Fay Sharpe LLP

(57) ABSTRACT

A coating apparatus for coating an associated product includes a conveyor mechanism for advancing the associated product, and an indexing system configured to index the associated product as it is advanced by the conveyor mechanism. The indexing system includes a product support member coupled to the conveyor mechanism for supporting the associated product during movement through the coating apparatus. The product support member includes a rotatable spindle shaft and an indexing member rotationally interlocked with the rotatable spindle shaft. The indexing member is configured to engage a guide surface of an adjacent first guide member as the product support member is advanced by the conveyor mechanism past the guide member to change an orientation of the rotatable spindle shaft. A locking mechanism is also included for locking rotation of the rotatable spindle.

15 Claims, 7 Drawing Sheets

DETAIL A
TOP COATING SPRAY HEAD SHOWN

DETAIL B
SIDE COATING SPRAY HEADS WITH INDEXING ACTION SHOWN 12
24
26
25
12
28
Spindle shaft (25)
Housing (28)
Chain (14)
Track (16)
44
30
34a
32
16
34b
14

30
16
Interlock Toggle (44)
Chain Guide (34a)
Alternate Chain Guide (34b)
32

Rotary Interlock Engaged

Rotary Interlock Disengaged

APPARATUS FOR COATING A PRODUCT AND A SYSTEM FOR INDEXING THE PRODUCT TO BE COATED

CROSS REFERENCE TO RELATED APPLICATIONS

This application claims the benefit of U.S. provisional application Ser. No. 61/523,519 filed Aug. 15, 2011, all of which is incorporated herein by reference

BACKGROUND

The present exemplary embodiment relates to an apparatus for coating fiber based products. It also finds particular application in conjunction with a coating process including a system for indexing parts to be coated, and will be described with particular reference thereto. However, it is to be appreciated that the present exemplary embodiment is also amenable to other like coating and/or manufacturing applications.

A number of disadvantages exist with prior coating machines and part conveyors. For one, prior art part conveyors typically use a spring detent mechanism to maintain the orientation of the part or product to be coated throughout the entire path that the part travels throughout the machine. If for any reason this detent fails or if the part is bumped out of position, the part may be spoiled and/or severe damage could occur to the machine. In addition, other prior art systems use electric components such as sensors, motors, servos, etc. to locate and reorient parts. These systems are not only highly expensive but also prone to reliability issues due to the harsh and unforgiving environment of the coating and heat curing processes.

Still another disadvantage, current chain-on-edge machines use a gear or sprocket attached to the part spindle which engages with a stationary gear/sprocket on the machine to reorient the spindle. The rotational speed of the spindle is thus controlled only by the ratio of the pitch diameters of these driving components and the speed at which the part spindle is moving through the machine. Since only a limited number of combinations of gears/sprockets exist (due to the upper and lower diameter limitations of these driving components), there are only a limited range of speeds at which the part spindle could be rotated. In addition, since a sprocket's diameter will remain constant, it will turn at the same speed in relation to the speed of the chain conveyor, regardless of where it is placed along the chain conveyor path in the machine.

Moreover, the prior art chain-on-edge sprocket systems do not provide for any method to selectively lock or fix the orientation of one or more part spindles in relation to the conveyor chain and/or the direction of travel. Also, such prior art sprocket systems cannot force a rotational stop which could allow inertia to cause the spindle to rotate too far. As such, the part spindles and the parts or products supported thereon, may become randomly oriented which further leads to quality control issues in the manufacturing process.

BRIEF DESCRIPTION

In accordance with one aspect, a coating apparatus for coating an associated product comprises a conveyor mechanism for advancing the associated product, and an indexing system configured to index the associated product as it is advanced by the conveyor mechanism. The indexing system includes a product support member coupled to the conveyor mechanism for advancement therewith, the product support member adapted to support the associated product during movement through the coating apparatus, the product support member including a rotatable spindle shaft and a first indexing member rotationally interlocked with the rotatable spindle shaft, the indexing member configured to engage a guide surface of an adjacent first guide member as the product support member is advanced by the conveyor mechanism past the guide member to change an orientation of the rotatable spindle shaft from a first angular position to a second angular position thereby rotating the associated product.

The coating apparatus can further comprise a second guide member for engaging a second indexing member rotationally interlocked with the rotatable spindle shaft, the second indexing member configured to engage a guide surface of the second guide member as the product support member is advanced by the conveyor mechanism past the second guide member to change an angular position of the rotatable spindle shaft and the associated product to a position different than at least one of the first angular position and the second angular position. The conveyor mechanism can include a chain supported for movement in a track of a frame, and wherein the product support member is received by the track for movement therealong.

The apparatus can also include a plurality of indexing members rotationally interlocked with the rotatable spindle shaft and a corresponding plurality of guide members, each indexing member configured to engage a guide surface of a corresponding guide member as the product support member is advanced by the conveyor mechanism along the track past the corresponding guide member to change an orientation of the rotatable spindle shaft. The plurality of guide members can be spaced along a length of the track such that, as the product support member is advanced along the length of the track, the rotatable spindle shaft is rotated to different orientations. At least two of the plurality of guide members can include guide surfaces spaced at different distances from the track for engaging with first and second indexing members spaced apart along an axial dimension of the rotatable spindle shaft.

The apparatus can further comprise a plurality of product support members having at least one indexing member and/or a plurality of guide members spaced along the track, two or more of said guide members having guide surfaces with different profiles for rotating respective rotatable spindle shafts at different rates at different locations along the track.

The apparatus can further include a spindle lock assembly for locking the rotatable spindle shaft against rotation. The spindle lock assembly can include a locking bushing fixed to the rotatable spindle shaft for rotation therewith, and a locking arm movable between a locked position whereat a portion of the locking arm is engaged with a portion of the locking bushing thereby restricting rotation of the locking bushing, and an unlocked position whereat rotation of the locking bushing is not restricted by the locking arm. The locking bushing can include a concave surface thereof, and the locking arm can include a corresponding convex surface thereof adapted to be received along the concave surface of the locking bushing when the locking arm is in the locked position. A biasing member can be provided for biasing the locking arm towards the locked or unlocked position. At least one toggle member can be provided for urging the locking arm to the locked or unlocked position.

The indexing member and/or or guide member(s) can have a variable slope surface whereby a variable rate of rotation of the spindle shaft is produced as the indexing member engages the guide member. The indexing system can include a smooth lobed cam and a smooth guide surface upon which the cam impinges.

In accordance with another aspect, a method of indexing a product in a coating apparatus comprises supporting the product on a rotating spindle shaft of an indexing system, advancing the rotating spindle through the coating apparatus with a conveyor mechanism, and rotating the product to a prescribed orientation with the indexing system as the conveyor mechanism advances the product through the coating apparatus. The rotating the product includes providing an indexing member fixed to the spindle for rotation therewith, the indexing member configured to engage a guide surface of an adjacent first guide member as the spindle shaft is advanced by the conveyor mechanism past the guide member to change an orientation of the spindle shaft from a first angular position to a second angular position thereby rotating the associated product.

DETAILED DESCRIPTION

Figure 1:
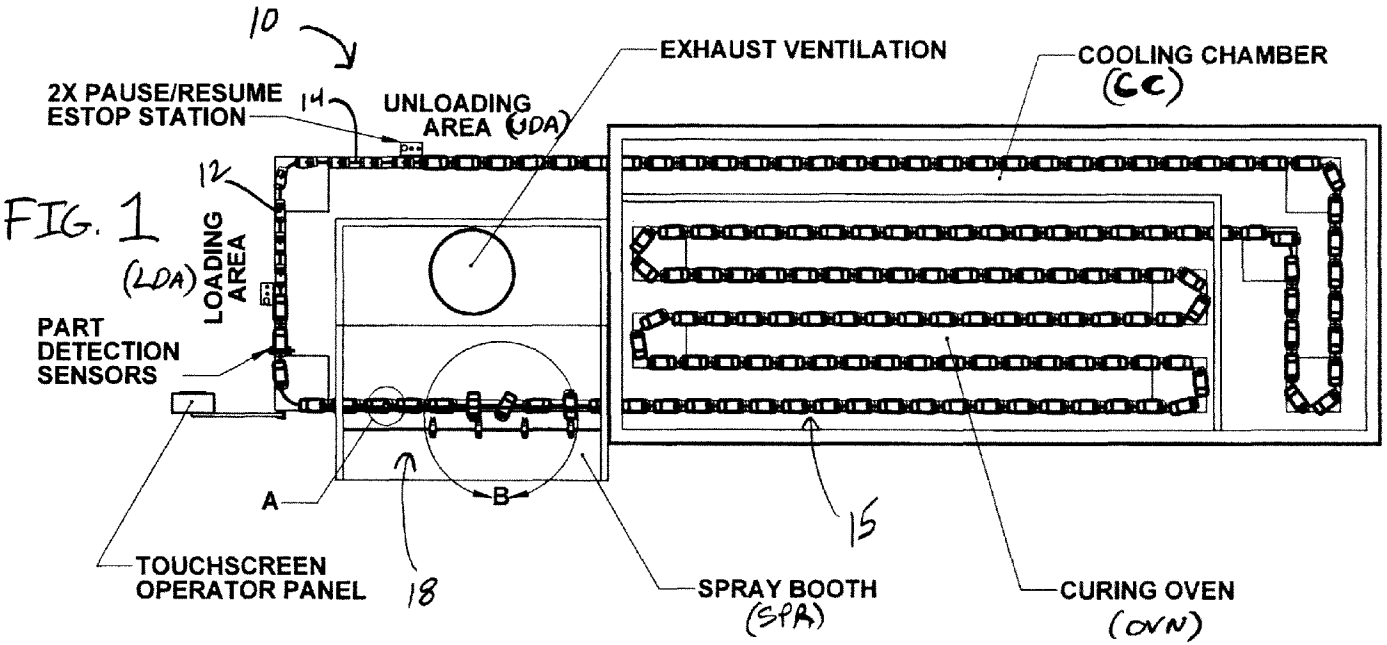
FIG. 1 is a top view of a first embodiment of a coating apparatus and a system for indexing a product to be coated, according to the present disclosure.
Figure 2:
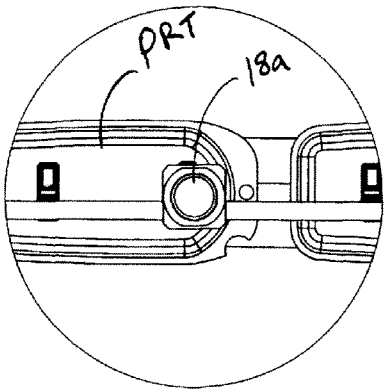
FIG. 2 is detailed view of a vertically-oriented spray head of the coating apparatus of FIG. 1.
Figure 3:
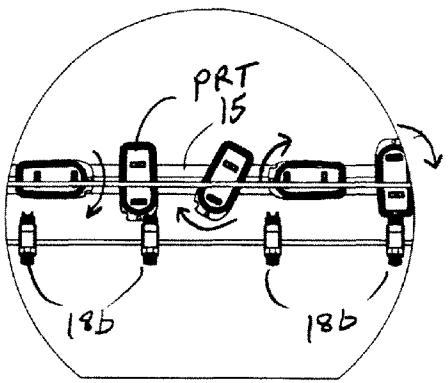
FIG. 3 is a top view of a series of side-oriented spray heads as well as a series of indexed positions of the product being coated of the coating apparatus of FIG. 1.
Figure 4:
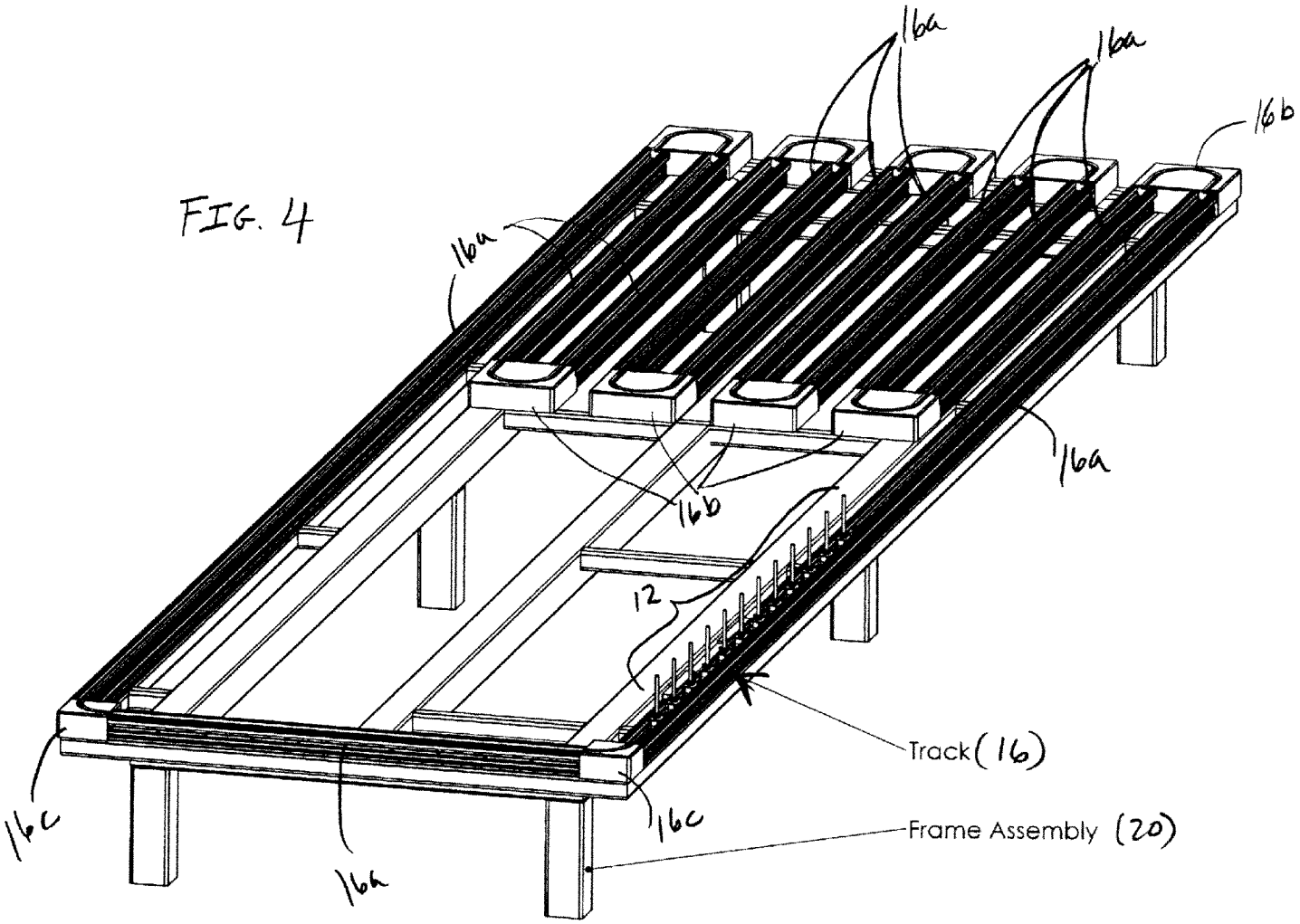
FIG. 4 is a perspective view of a track and frame assembly for a second embodiment of a coating apparatus, according to the present disclosure.

With reference to FIGS. 1-3, a coating apparatus 10 is shown for coating parts or products, such as fiber based products with various types of coatings, such as a waterproof film, etc. Generally, the coating apparatus 10 includes a plurality of spindle assemblies 12 which are secured to a chain-on-edge type conveyor 14. Both the spindle assemblies 12 and the chain-on-edge conveyor 14 can be slidably engaged within a track assembly 15 (FIG. 4). Once a product or part to be coated PRT is mounted or otherwise loaded onto an individual spindle assembly 12 within the loading area LDA, the chain conveyor 14 may advance the spindle assembly 12 and part PRT through a spray booth SPR. As the part to be coated PRT advances through the spray booth SPR, a series of spray heads 18 may be located in various orientations, such as a top or side orientation with respect to the part to be coated PRT. By way of example, the part PRT may have its top side coated by a top or vertically-oriented coating spray head 18A (FIG. 2) and the sides of the part PRT coated using on or more side-oriented spray heads 18B (FIG. 3). In addition, as shown in FIG. 3, and as will be described in greater detail below, the spindle assemblies 12 may be selectively locked and unlocked allowing the part PRT to rotate or index about a vertical axis. As such, the spindle assembly 12 can be manipulated so as to present the various facets or sides of the part PRT to be coated to one or more spray heads while the part PRT moves through the spray booth SPR or at any desired location along the track 15.

Permitting the product or part to be manipulated in such a manner provides a particular advantage in the coating process as it allows the part to be uniformly coated in a very compact space while utilizing a generally unidirectional flow of air and spray coating material through the spray booth. Once the part to be coated PRT is coated, it may then be advanced through a curing oven OVN through which the conveyor 14 and track assembly 15 may make several passes in a serpentine-like course. Once the coated parts PRT have dwelled for an adequate period of time within the oven OVN, the parts may advance through a cooling chamber CC to be cooled to an appropriate handling temperature. Finally, the parts PRT may advance to an unloading area UDA where they may be unloaded, packaged or presented to another machine for further processing. Naturally, one or more aspect of the coating apparatus 10 may be fully automated (e.g., as in the automated loading and unloading of parts, heating and cooling control, part detection, etc.)

Now with reference to FIG. 4, a track 16 and frame assembly 20 is illustrated for an alternate embodiment of a coating apparatus, but which is generally similar to the first embodiment of the coating apparatus 10. As illustrated in FIG. 4, the plurality of spindle assemblies 12 can be slidably engaged within the track 16 which may also house the chain-on-edge conveyor 14 previously described or any other conveyor mechanism that is capable of advancing the spindle assemblies 12 through the track 16. While only a small portion of the track 16 is shown as being populated with spindle assemblies 12, the entire course of the track 16 would generally be used and filled with spindles 12 in order to make the most effective and productive use of the coating apparatus. In addition, the track 16 can be constructed from a series of linear track portions 16A, one or more U-shaped end portions 16B, and one or more corner portions 16C. The U-shaped and corner portions 16B, 16C may otherwise include drive systems used in driving or advancing the chain on edge conveyor or other conveyor type system. Furthermore, the radius of curvature of the track portion within the U-shaped and corner portions or segments are fashioned to accommodate the spindle assemblies 12 so that they may traverse the entire track length without interference or otherwise binding. In alternate embodiments, the U-shaped end and corner portions may be entirely eliminated as a chain-on-edge conveyor may provide adequate vertical rigidity when a portion of the conveyor is temporarily disengaged from the track (as one or more spindle assemblies negotiate a turn or curved portion of the course). Also, as noted with regard to the first embodiment of the coating apparatus 10 (FIG. 1), the overall course of the track 16 can be divided into various regions for spraying, curing, cooling, loading and unloading, or other operations as needed to achieve the desired end result for the part to be coated.

Figure 5:
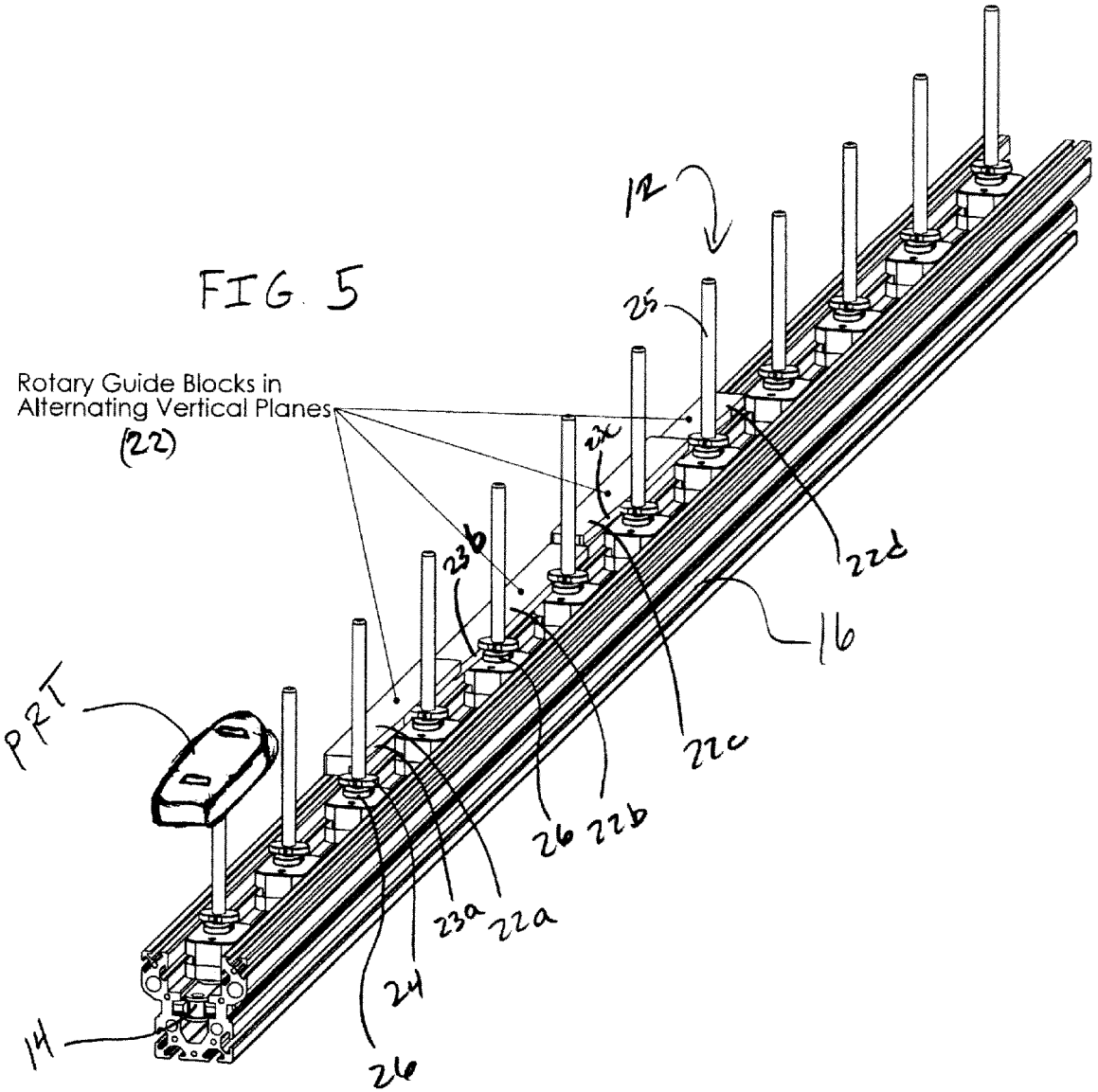
FIG. 5 is a perspective view of a portion of the track assembly of the coating apparatus of FIG. 4, illustrating a plurality of indexable spindle assemblies engaged therein.
Figure 6:
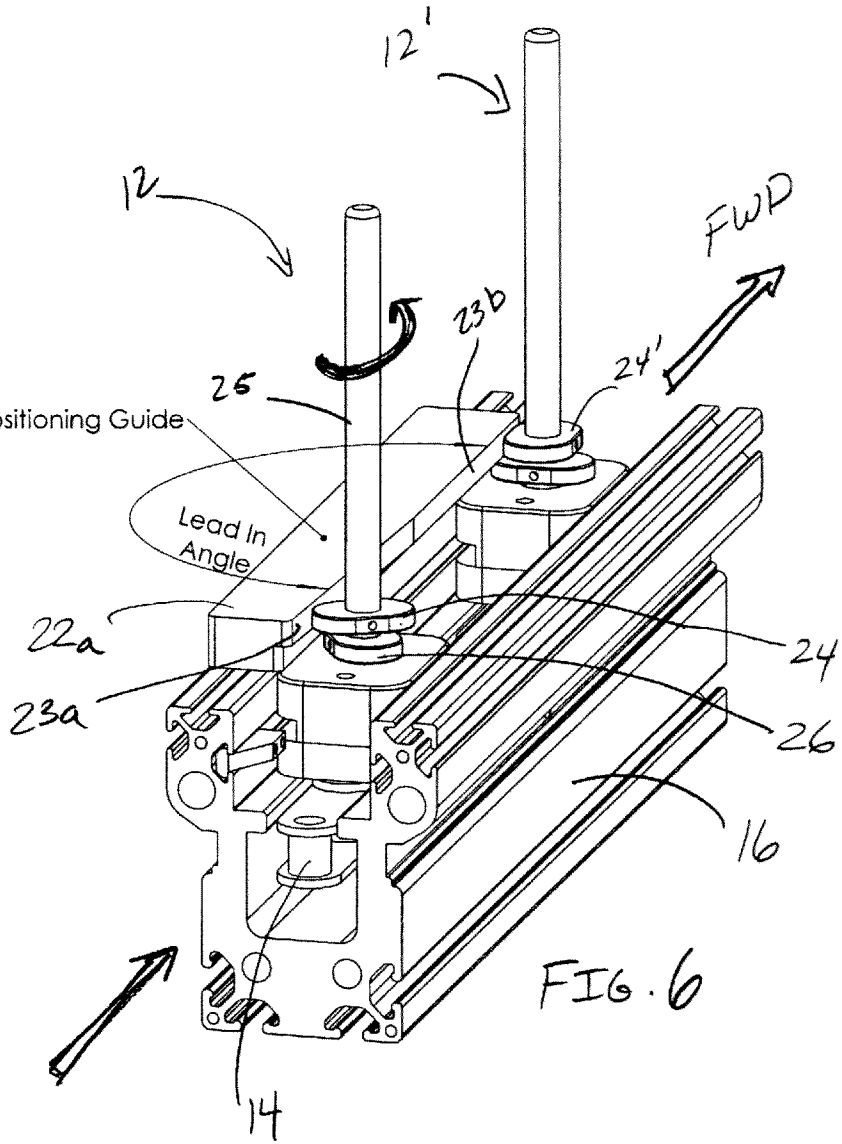
FIG. 6 is a perspective view of a portion of the track assembly of FIG. 5, illustrating the indexing action of the spindle assembly with a rotary positioning guide member.

Now with reference to FIG. 5, a portion of the track 16 is illustrated containing the plurality of spindle assemblies 12 previously discussed. In addition, a part to be coated PRT is also illustrated in a mounted or loaded configuration on the first spindle in FIG. 5. Furthermore, and as will be discussed in greater detail with reference to FIGS. 6-9, the track assembly 16 is designed to accommodate the individual spindles, as well as the individual segments of the chain-on-edge conveyor 14. In addition, a series of guide member 22 can be used to control the indexing or rotational orientation of the parts PRT supported by the spindle assemblies as they traverse past the guide members 22. Generally, as a spindle 12 encounters a first guide 22A, an upper or first indexing member 24 of the spindle 12 will slidably engage an edge portion 23A, causing the indexing member 24 to rotate a spindle shaft 25 of the spindle assembly 12. By way of example, in the instant embodiment the spindle shaft will rotate by approximately 90° as it passes by the first guide 22*a*. Of course, the amount and rate of rotation of the spindle shaft 25 and the part PRT can be controlled by the profile, slope, or lead angle of the edge 23A as illustrated in FIG. 6. Naturally, the more aggressive the profile or lead angle of edge 23A, the greater or faster the rate of turn will be per unit travel of the conveyor. Also of note here, the guides could be positioned in sequence to cause constant rotation of the part at any rate desired.

As the spindle 12 passes the first guide 22A, the spindle 12 may encounter a second or subsequent guide 22B. The second guide 22B may be disposed at a lower elevation with respect to the first guide 22A, such that a second or lower indexing member 26 may slidably engage a lead in profile or edge 23B. As the second indexing member 26 engages the edge 23*b*, the spindle shaft 25 will be urged to rotate by approximately another 90°, thus presenting the next side of the mounted part PRT to be coated. Next, the indexing process is repeated (as described with regard to the first guide 22A) by the third guide 22C since the third guide 22C is at the same or similar elevation of the first guide 22A. Here again, the upper or first indexing member 24 will engage the profile or edge of the guide 23C, thus causing the spindle to rotate yet another 90° and present a different surface of the part to be coated. Finally, the fourth guide 22D is disposed at the same level as the second guide 23B which again engages the second or lower indexing member 26 to bring the part PRT back to its original orientation.

It should be noted that any number of indexing members and guides could be combined at various heights and contours, respectively, to achieve any number of spindle/part orientations and angular rates of turn. Furthermore, the spindle assemblies may be modified to include multiple degrees of freedom so that a part can be manipulated in different planes/axes. By way of example, a mounted part could be manipulated in more than one plane/axis by using a combination of nested part spindles, angled drive systems, multiple guide/indexing members, and/or spindle locks, etc.

Figure 7:
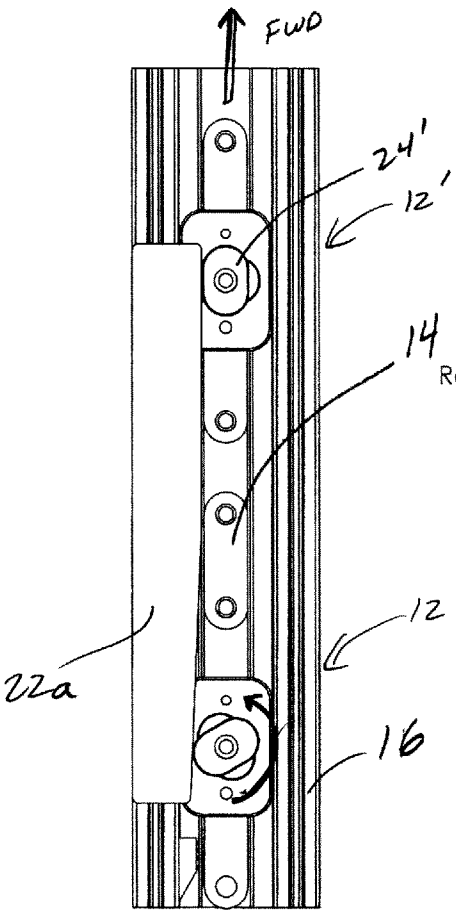
FIG. 7 is a top view of the portion of the track and spindle assembly of FIG. 6.

The process of indexing or rotation of the spindle 12 is further illustrated in FIGS. 6 and 7. As shown in FIG. 6, the spindle 12 and upper indexing member 24 begin to rotate in a counterclockwise direction, as the conveyor is moved in a forward direction FWD. As can be seen by comparing the leading spindle assembly 12' and the upper indexing member 24' to the lagging spindle assembly 12 and the upper indexing member 24 of FIG. 6, once the leading spindle assembly 12' has passed the profile or edge 23A of the guide 22A, the leading upper indexing member 24' is oriented in a generally parallel direction with the edge surface 23B of the guide 22A. It should be noted, that between, during, before, or after the various indexing operations as provided by the guides 22, the spindle assembly may be locked such that any movement or rotation of the spindle shaft is prevented or precluded. This provides the particular advantage of maintaining the same orientation (relative to the conveyor/track) of all the parts which are moving through the coating apparatus which further simplifies subsequent operations (e.g., loading and unloading of parts, etc.). Of course, the spindle shafts of the spindle assemblies could be rotated and oriented using alternate mechanisms using gears, racks, chains and/or motors.

Figures 8, 9:
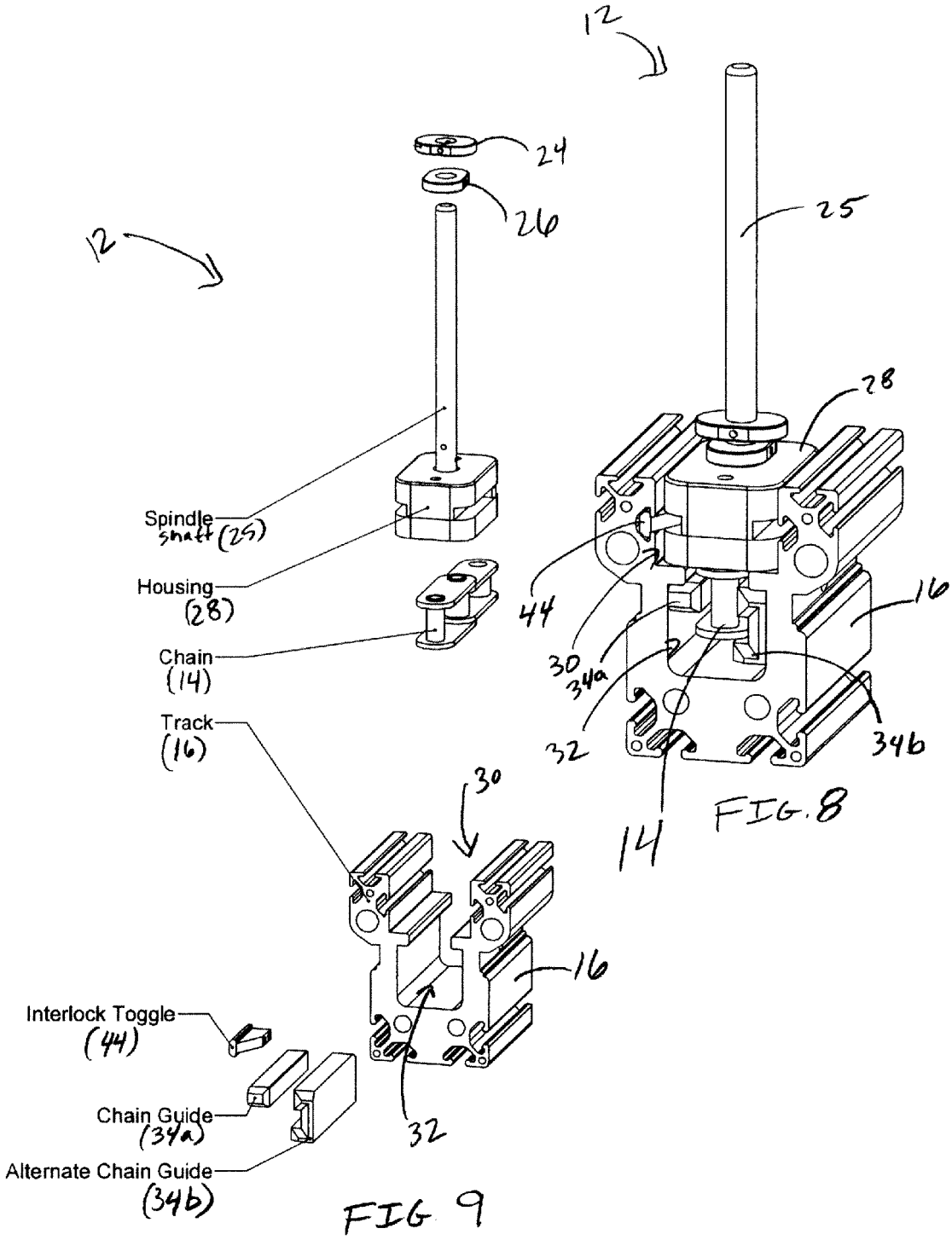
FIG. 8 is a perspective view of an individual spindle assembly engaged within a portion of the track of FIG. 5.
FIG. 9 is an exploded view of the spindle and track assemblies of FIG. 8.

Now with reference to FIGS. 8 and 9, a single spindle assembly 12 is illustrated in an assembled view and an exploded view, respectively. As discussed previously, a housing 28 of the spindle assembly 12 is slidably engaged within a first channel 30 of the track 16. The chain 14 of the chain-on-edge conveyor may also move within the track 16 within a second channel 32. An upper portion of the chain 14 may be secured to a lower portion of the housing 28, such that as the chain is urged through the track, the housing 18 and spindle assembly 12 are also urged in the same direction. To prevent the chain or conveyor 14 from interfering or otherwise binding within the channel 32 or track 16, one or more chain guides 34A, 34B may be provided. The chain guides 34A, 34B may be fabricated from any common or suitable bearing material (e.g., bronze, brass, nylon, Delrin, etc.). Furthermore, the housing 28 of the spindle assembly may also be provided with similar bearing surfaces to facilitate a low friction and small tolerance interface between the spindle assembly and the track.

Figure 10:
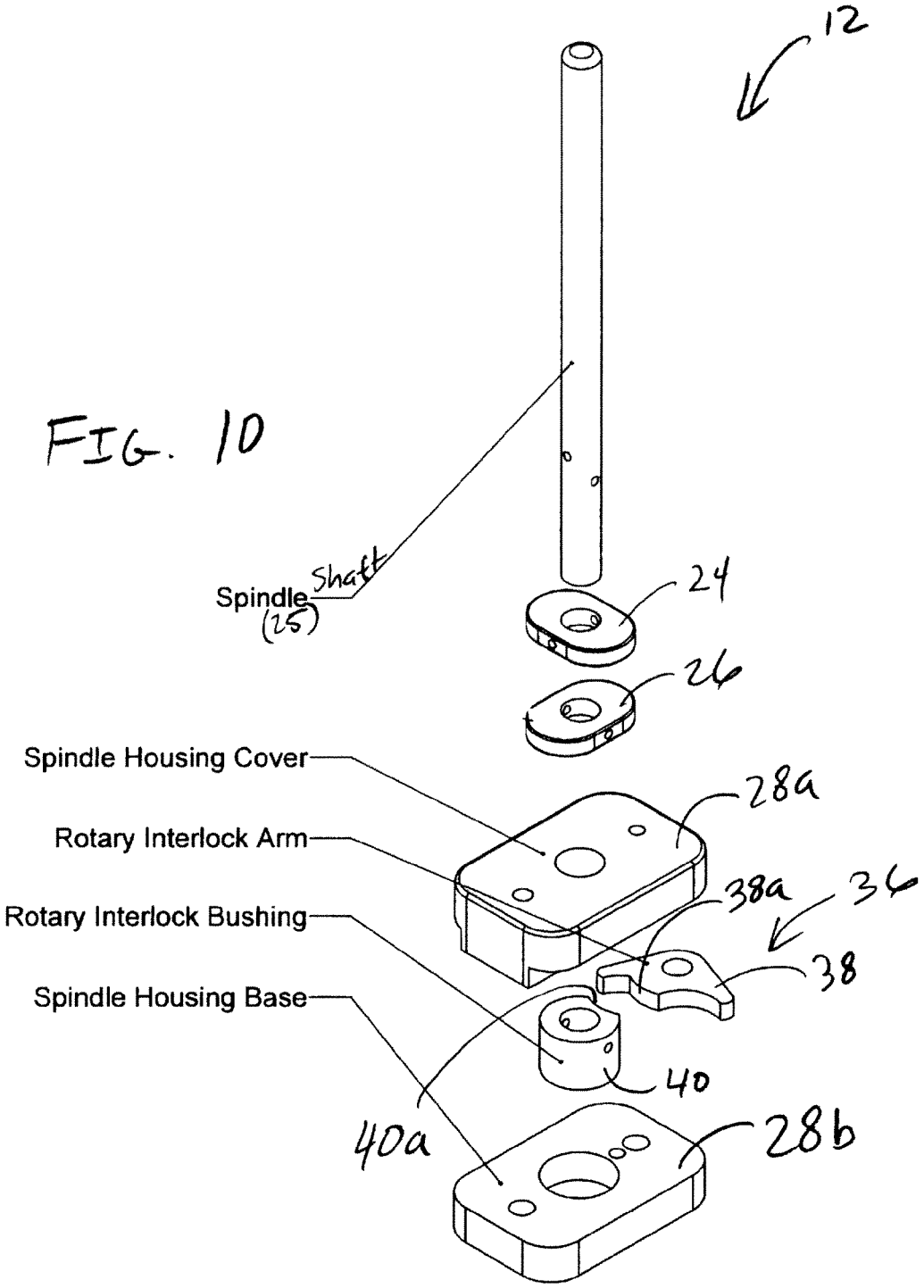
FIG. 10 is a further exploded view of the spindle assembly and spindle housing illustrated in FIG. 9.

Now with reference to FIG. 10, an exploded view of the upper portion of the spindle assembly 12 is shown further illustrating the spindle shaft 25; the first and second indexing members 24, 26; an upper portion of the housing 28A; and, a lower portion of the housing 28B. In addition, a spindle lock assembly 36 is illustrated which includes a locking arm 38 and a locking bushing 40. The locking arm 38 may generally include a first end 38A, a second end 38B, and convex locking surface 38C. The locking arm 38 may also be pivotally mounted between the upper and lower housing portions 28A, 28B, while the locking bushing 40 may otherwise be secured to the spindle shaft 25. It should also be noted that the locking bushing 40 may include a concave surface 40A which matches a radius of curvature of the convex portion 38C of the locking arm 38. Furthermore, a spring loaded detent may be provided within either the upper or lower housing portions 28A, 28B to retain the locking arm 38 in either a locked/engaged state or an unlocked/disengaged state. As illustrated and discussed below with reference to FIG. 13, when the locking arm 38 is in the engaged state, the convex surface 38C is generally in contact with or proximal to the concave surface 40A of the bushing.

Figure 11:
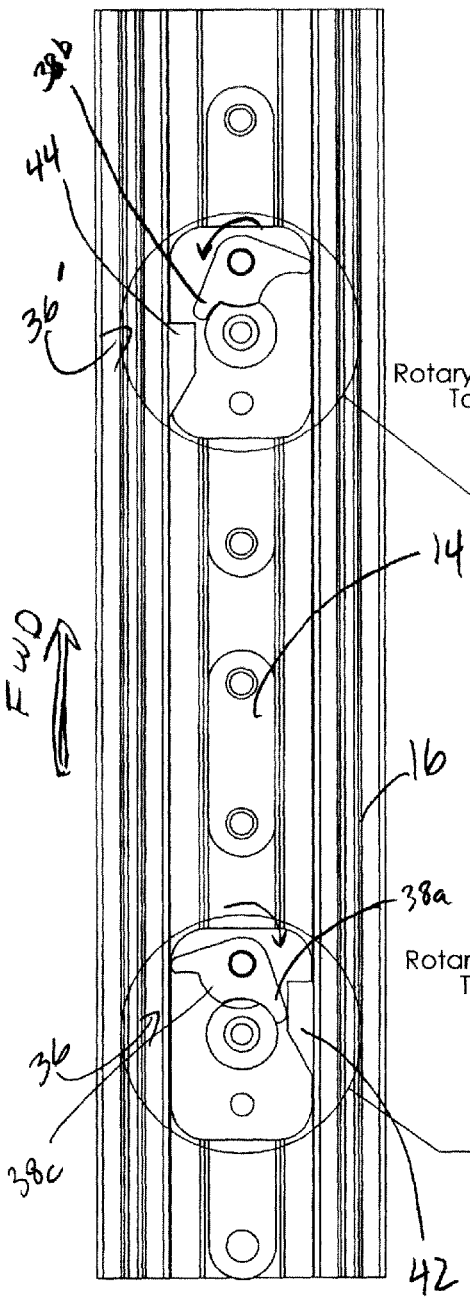
FIG. 11 is a top view of a spindle locking assembly with an upper portion of the spindle housing removed for clarity.
Figure 13:
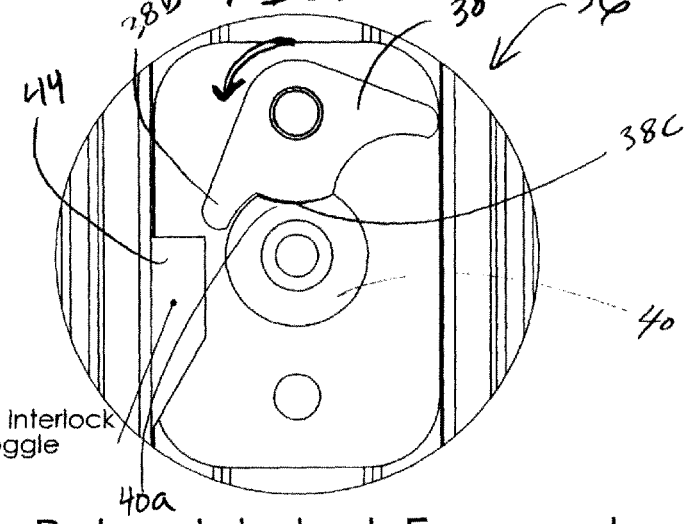
FIG. 13 is a detailed view of FIG. 11 of the spindle locking assembly in an engaged or locked state.
Figure 12:
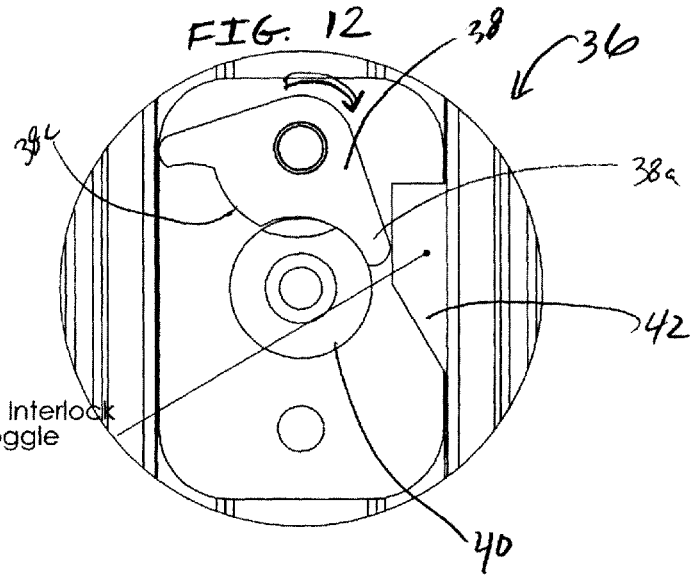
FIG. 12 is a detailed view of FIG. 11 illustrating the spindle locking assembly in a disengaged or unlocked state.

Now with reference to FIGS. 11-13, the locking action of the spindle lock 36 is illustrated. With particular reference to FIG. 11, a leading spindle lock assembly 36' is illustrated in the locked state while the lagging spindle lock assembly 36 is shown in the unlocked state. As the spindle assembly traverses in the forward direction FWD through the track 16 and encounters a first toggle 42, the first toggle 42 urges the first end 38A of the locking arm 38 urged in a clockwise direction. As the locking arm 38 rotates clockwise, the convex portion 38C moves away from and disengages the concave surface 40A of the bushing 40 thereby allowing the bushing 40 (spindle shaft) to rotate freely within the spindle housing 28. Similarly, and in a generally opposite sequence of events, as the conveyor 14 moves forward FWD within the track 16, the same spindle assembly may eventually encounters a second toggle 44. As the second end 38B of the locking arm 38 encounters the second toggle 44, it is urged in a counterclockwise direction thereby placing the spindle lock assembly 36' into a locked or engaged state. Specifically, this occurs because the convex portion 38C engages the concave portion 40A of the bushing 40 thereby precluding any relative movement between the bushing 40 and spindle 25 with respect to the housing 28 of the spindle assembly 12.

As disclosed above, the spindle assemblies and chain can be contained and guided by a track with a specific profile. The profile of the track could be made by extruding aluminum or plastic or it could be machined. Other parts, channels, or surface features can be added to the track (or formed therein as part of the extrusion) for additional stability or functionality. Other guides can be attached to capture the chain or more complicated guides could be added to capture the chain and add stability. Here, the track design may accomplish multiple objectives. It may support the chain as well as provide a surface for the spindle housing to ride upon. By capturing the chain and spindle housing, it provides stability to the whole assembly. As illustrated, various chain guide designs could be employed to capture more or less of the chain, depending on the level of chain stability that is required. Furthermore, externally accessible channels could be incorporated as part of the design of the track profile to allow for the ease of securing the track to the frame and for the mounting of other components (e.g., part spindle index guides, spindle interlock trigger/toggle, electrical/mechanical sensors, and/or machine guards, etc.).

As discussed previously, prior art chain-on-edge machines use a gear or sprocket attached to the part spindle which engages with a stationary gear/sprocket on the machine to index or reorient the spindle. This offers only a limited range of speeds at which the part spindle can be rotated and whichever speed is selected is the only speed that can be used throughout the pathway of the driving chain conveyor. By contrast, and in accordance with the indexing system of the present disclosure, the indexing guides could be shaped differently in different areas of the machine so that various rates of rotation could be accomplished regardless of chain conveyor speed, etc. The indexing guides could even be contoured to achieve non-linear rates of rotation if needed.

Also, as previously mentioned, the prior art chain-on-edge sprocket systems do not provide for any method to selectively lock or fix the orientation of one or more part spindles in relation to the conveyor chain and/or the direction of travel. As such, the part spindles and the parts or products supported thereon, may become randomly oriented which further leads to quality control issues in the manufacturing process. The interlock system of the present disclosure addresses this problem by allowing the machine to force an absolute spindle orientation. As described previously, toggles placed in the track can engage or disengage the interlock or locking assembly of the spindle assemblies at any desired point. Due to its design, the interlock can only be engaged when the spindle is in its proper orientation. This design allows for the simple addition of electronic sensors for the control system to verify proper spindle orientation in various areas of the machine. If improper spindle orientation is detected via the position of the locking arm, the machine can be programmed to automatically stop. In areas of the machine where the spindle needs to be reoriented, the spindle locking assembly would be disengaged and the previously disclosed indexing system could be used.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A coating apparatus for coating an associated product comprising:

a conveyor mechanism for advancing the associated product; and an indexing system configured to index the associated product as it is advanced by the conveyor mechanism;

wherein the indexing system includes a product support member coupled to the conveyor mechanism for advancement therewith, the product support member adapted to support the associated product during movement through the coating apparatus, the product support member including a rotatable spindle shaft and a first indexing member rotationally interlocked with the rotatable spindle shaft, the first indexing member configured to engage a guide surface of an adjacent first guide member as the product support member is advanced by the conveyor mechanism past the guide member to change an orientation of the rotatable spindle shaft from a first angular position to a second angular position thereby rotating the associated product; and further comprising a second guide member for engaging a second indexing member rotationally interlocked with the rotatable spindle shaft, the second indexing member configured to engage a guide surface of the second guide member as the product support member is advanced by the conveyor mechanism past the second guide member to change an angular position of the rotatable spindle shaft and the associated product to a position different than at least one of the first angular position and the second angular position.

2. A coating apparatus for coating an associated product comprising:

a conveyor mechanism for advancing the associated product; and an indexing system configured to index the associated product as it is advanced by the conveyor mechanism;

wherein the indexing system includes a product support member coupled to the conveyor mechanism for advancement therewith, the product support member adapted to support the associated product during movement through the coating apparatus, the product support member including a rotatable spindle shaft and a first indexing member rotationally interlocked with the rotatable spindle shaft, the first indexing member configured to slidingly engage and translate along a guide surface of an adjacent first guide member as the product support member is advanced by the conveyor mechanism past the guide member to change an orientation of the rotatable spindle shaft from a first angular position to a second angular position thereby rotating the associated product;

wherein the conveyor mechanism includes a chain supported for movement in a track of a frame, and wherein the product support member is received by the track for movement therealong.

3. The coating apparatus of claim 2, further comprising a plurality of product support members having at least one indexing member.

4. The coating apparatus of claim 2, further comprising a spindle lock assembly for locking the rotatable spindle shaft against rotation.

5. The coating apparatus of claim 4, wherein the spindle lock assembly includes a locking bushing fixed to the rotatable spindle shaft for rotation therewith, and a locking arm movable between a locked position whereat a portion of the locking arm is engaged with a portion of the locking bushing thereby restricting rotation of the locking bushing, and an unlocked position whereat rotation of the locking bushing is not restricted by the locking arm.

6. The coating apparatus of claim 5, wherein the locking bushing includes a concave surface thereof, and the locking arm includes a corresponding convex surface thereof adapted to be received along the concave surface of the locking bushing when the locking arm is in the locked position.

7. The coating apparatus of claim 5, further comprising a biasing member for biasing the locking arm towards the locked or unlocked position.

8. The coating apparatus of claim 5, further comprising at least one toggle member for urging the locking arm to the locked or unlocked position.

9. The coating apparatus of claim 2, wherein at least one of the indexing member or guide member has a variable slope surface whereby a variable rate of rotation of the spindle shaft is produced as the indexing member engages the guide member.

10. The coating apparatus of claim 2, wherein the indexing system includes a smooth lobed cam and a smooth guide surface upon which the cam impinges.

11. The coating apparatus of claim 2, further comprising at least one spray head for spraying a coating on the associated product.

12. A coating apparatus for coating an associated product comprising:

a conveyor mechanism for advancing the associated product; and an indexing system configured to index the associated product as it is advanced by the conveyor mechanism;

wherein the indexing system includes a product support member coupled to the conveyor mechanism for advancement therewith, the product support member adapted to support the associated product during movement through the coating apparatus, the product support member including a rotatable spindle shaft and a first indexing member rotationally interlocked with the rotatable spindle shaft, the first indexing member configured to engage a guide surface of an adjacent first guide member as the product support member is advanced by the conveyor mechanism past the guide member to change an orientation of the rotatable spindle shaft from a first angular position to a second angular position thereby rotating the associated product;

wherein the conveyor mechanism includes a chain supported for movement in a track of a frame, and wherein the product support member is received by the track for movement therealong, and further comprising a plurality of indexing members rotationally interlocked with the rotatable spindle shaft and a corresponding plurality of guide members, each indexing member configured to engage a guide surface of a corresponding guide member as the product support member is advanced by the conveyor mechanism along the track past the corresponding guide member to change an orientation of the rotatable spindle shaft.

13. The coating apparatus of claim 12, wherein the plurality of guide members are spaced along a length of the track such that, as the product support member is advanced along the length of the track the rotatable spindle shaft is rotated to different orientations.

14. The coating apparatus of claim 12, wherein at least two of the plurality of guide members include guide surfaces spaced at different distances from the track for engaging with first and second indexing members spaced apart along an axial dimension of the rotatable spindle shaft.

15. The coating apparatus of claim 13, wherein two or more of said guide members have guide surfaces with different profiles for rotating respective rotatable spindle shafts at different rates at different locations along the track.

* * * * *